US006116443A

United States Patent [19]

Parrinello

[11] Patent Number: 6,116,443

[45] Date of Patent: Sep. 12, 2000

[54] PLASTIC SCREW CAP WITH TAMPER-EVIDENT RING

[75] Inventor: Fiorenzo Parrinello, Medicina, Italy

[73] Assignee: Sacmi Cooperativa Meccanici Imola S.c.r.l., Imola, Italy

[21] Appl. No.: 09/181,545

[22] Filed: Oct. 29, 1998

[30] Foreign Application Priority Data

Sep. 9, 1998 [IT] Italy ..... B098A0523

[51] Int. Cl.[7] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,206,851 | 6/1980 | Ostrowsky | 215/252 X |
| 4,899,898 | 2/1990 | Thompson | 215/252 |
| 5,257,705 | 11/1993 | De Santana | 215/252 |
| 5,295,600 | 3/1994 | Kowal | 215/252 |
| 5,358,131 | 10/1994 | McCandless et al. | 215/252 |
| 5,542,556 | 8/1996 | Ohmi et al. | 215/252 X |
| 5,564,582 | 10/1996 | Kamath | 215/252 |
| 5,609,263 | 3/1997 | Perchepied | 215/252 |
| 5,673,809 | 10/1997 | Ohmi et al. | 215/252 |
| 5,740,932 | 4/1998 | Battegazzore | 215/252 |
| 5,779,075 | 7/1998 | Salmon et al. | 215/252 |
| 5,860,542 | 1/1999 | Takamatsu | 215/252 X |
| 5,875,906 | 3/1999 | Price et al. | 215/252 |

*Primary Examiner*—Nathan J. Newhouse

*Attorney, Agent, or Firm*—Guido Modiano; Albert Josif; Daniel O'Byrne

[57] ABSTRACT

A plastic screw cap of the type composed of a cylindrical cup provided with an internal thread and with a tamper-evident ring attached to the rim of the cup, the ring being provided with a retention collar engaging below an annular ridge of a container whereto the cap is applied, wherein the rim of the cup and the border of the ring, except for at least one angularly arranged portion constituting a connection region, are mutually separated by incisions which run all along the circumference of the tamper-evident ring by cutting through the thickness thereof.

6 Claims, 6 Drawing Sheets

PLASTIC SCREW CAP WITH TAMPER-EVIDENT RING

BACKGROUND OF THE INVENTION

The present invention relates to a plastic screw cap with tamper-evident ring.

Caps of the above type are already commercially known. They comprise a cylindrical cup which is threaded internally so that it can be screwed onto the top of the container (bottle). A so-called tamper-evident ring is attached to the rim of the cup by means of breakable bridges and is internally provided with engagement elements constituted by flaps or by a collar which, when the cap is applied so as to close the container, engage below an annular retention ridge of the container. By unscrewing the cap, the flaps or the collar abut against the annular ridge and retain the ring, while the resulting axial traction force breaks the bridges.

However, in currently commercially available caps breaking bridges entails a significant physical effort, owing to the fact that the traction force during unscrewing must overcome the mechanical contrast opposed by all the bridges simultaneously. In practice, the unscrewing force must be such as to break a cross-section which is equal to the sum of the cross-sections of the bridges.

SUMMARY OF THE INVENTION

The aim of the present invention is to provide a plastic cap capable of substantially obviating the shortcomings of conventional caps, i.e., capable of reducing the effort that must be applied to the cap in order to achieve separation of the tamper-evident ring from the cup or to reveal any tampering.

This aim is achieved with a plastic screw cap of the type composed of a cylindrical cup provided with an internal thread and with a tamper-evident ring attached to the rim of the cup, said ring being provided with means for retention below an annular ridge of a container to which the cap is applied, characterized in that the rim of said cup and of said ring, except for at least one angularly arranged portion, are mutually separated by incisions which run along the circumference and pass through the thickness of the tamper-evident ring along the region for connection to the rim of the cup.

BRIEF DESCRIPTION OF THE DRAWINGS

Further characteristics and advantages of the present invention will become apparent from the following detailed description on the basis of the accompanying drawings, wherein.

DESCRIPTION OF THE PREFERRED EMBODIMENTS

Figure 1:
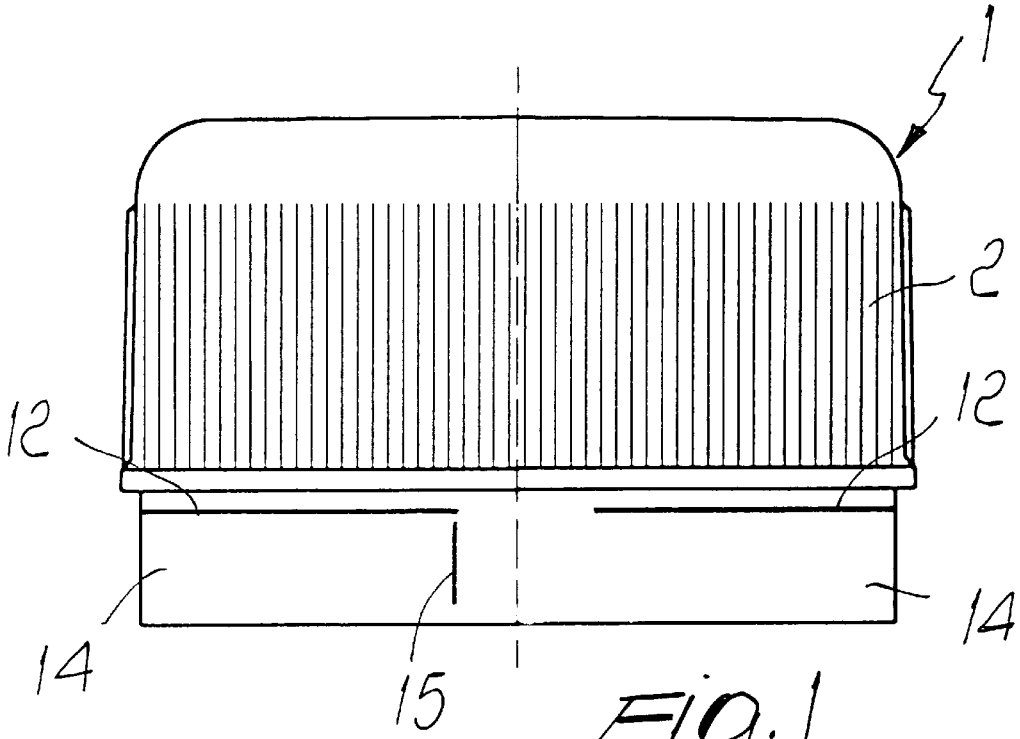
FIG. 1 is a view of a cap according to the invention.
Figure 2:
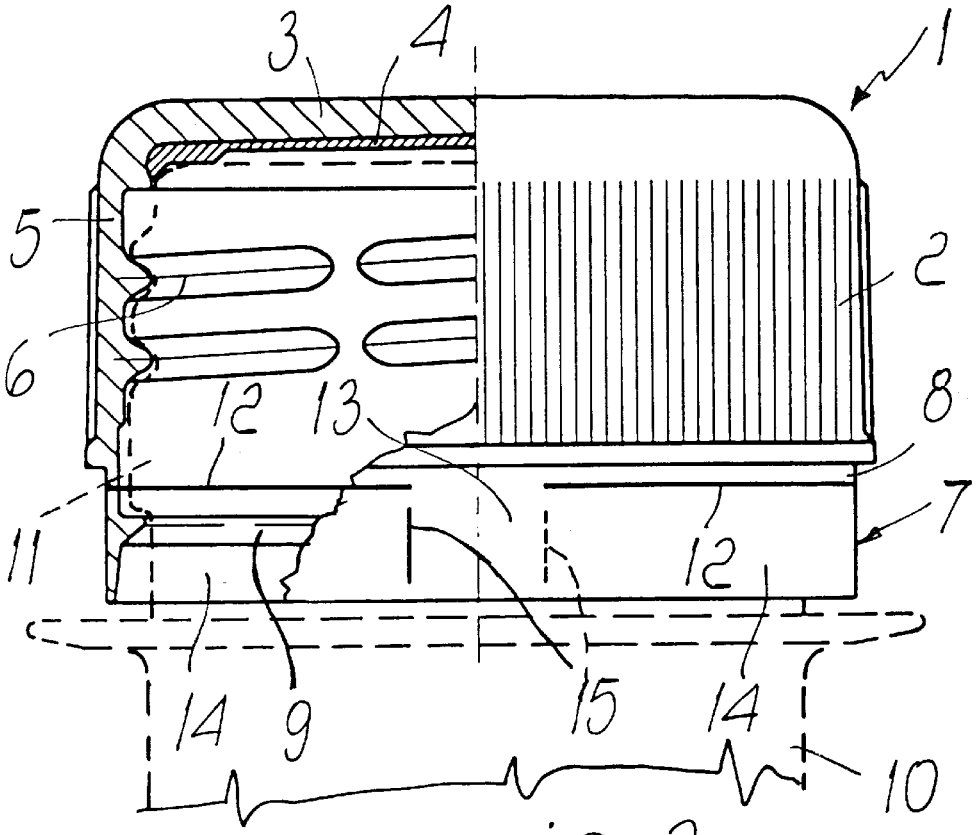
FIG. 2 is a partially sectional view of the cap of FIG. 1.
Figure 3:
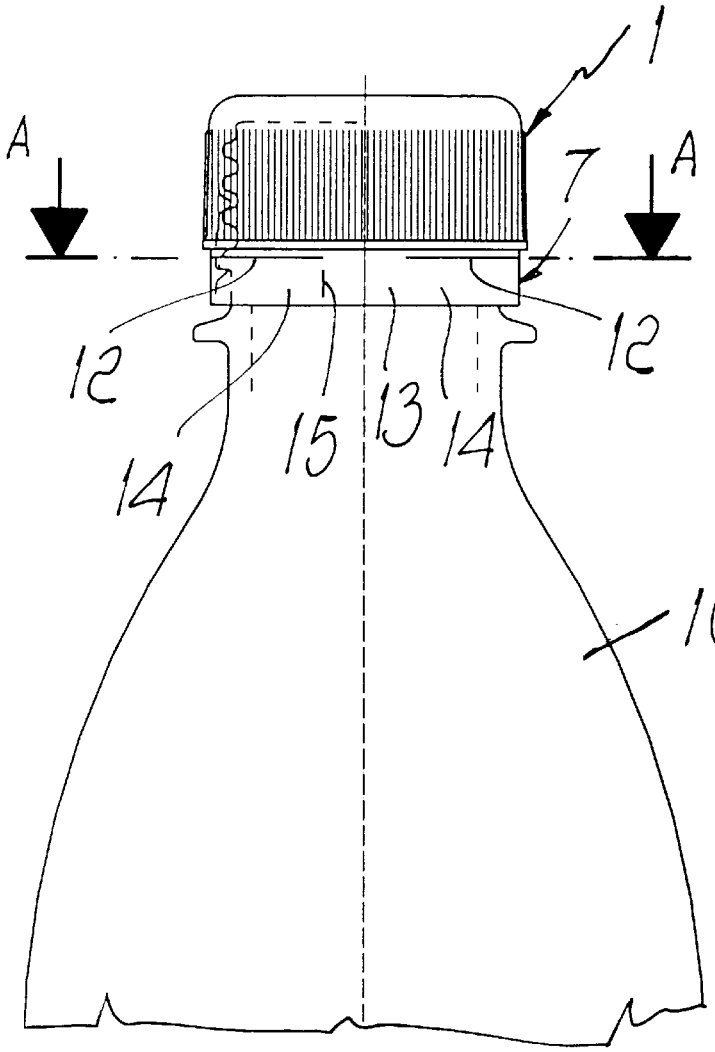
FIG. 3 is an elevation view of a container whereto the cap of FIG. 1 has been applied.

With reference to the above figures, the reference numeral 1 generally designates a cap according to the present invention, obtained by molding plastics according to conventional methods. The cap 1 comprises a cylindrical cup 2 composed of a bottom 3 which is internally covered by a liner 4 and by a cylindrical wall 5 inside which a thread 6 is formed.

A tamper-evident ring 7 protrudes from the rim of the cylindrical wall 5 of the cup 2 and is composed of a cylindrical wall which is connected to the rim of the cup 2 by a connecting region 8 and is provided with a continuous internal collar 9 protruding inwards.

The inside diameter of the ring 7 is significantly smaller than the inside diameter of the wall 5 of the cup. This difference in thickness allows the tamper-evident ring to be more elastic and allows it to follow any widening occurring during the application of the cap to a container 10, in order to allow engagement of the collar 9 below an annular ridge 11 of the neck of the container.

Two incisions 12 are formed in the connecting region 8 and run along the circumference except at two portions which cover a certain angle and are designated hereinafter as bridges 13 for the sake of convenience in description. The bridges 13 are in practice the only portions by means of which the tamper-evident ring 7 remains attached to the cup 2 and are mutually connected by the portions 14 of the tamper-evident ring that lie circumferentially between them.

An axial incision 15 is formed on the tamper-evident ring 7 to the side of each bridge 13 and does not intersect the circumferential incisions 12 but ends in their vicinity. The axial incisions 15 can be through incisions or not and can comprise a single portion or a portion provided with discontinuities.

According to the fundamental prerogative of the present invention, the through circumferentially incisions 12 can facilitate and ensure the engagement of the tamper-evident ring 7 below the annular ridge 11 of the container 10.

Figure 4:
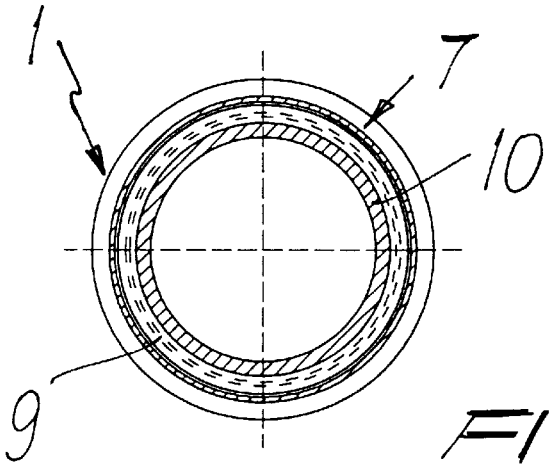
FIG. 4 is a sectional view, taken along the sectional plane A—A of FIG. 3.
Figure 5:
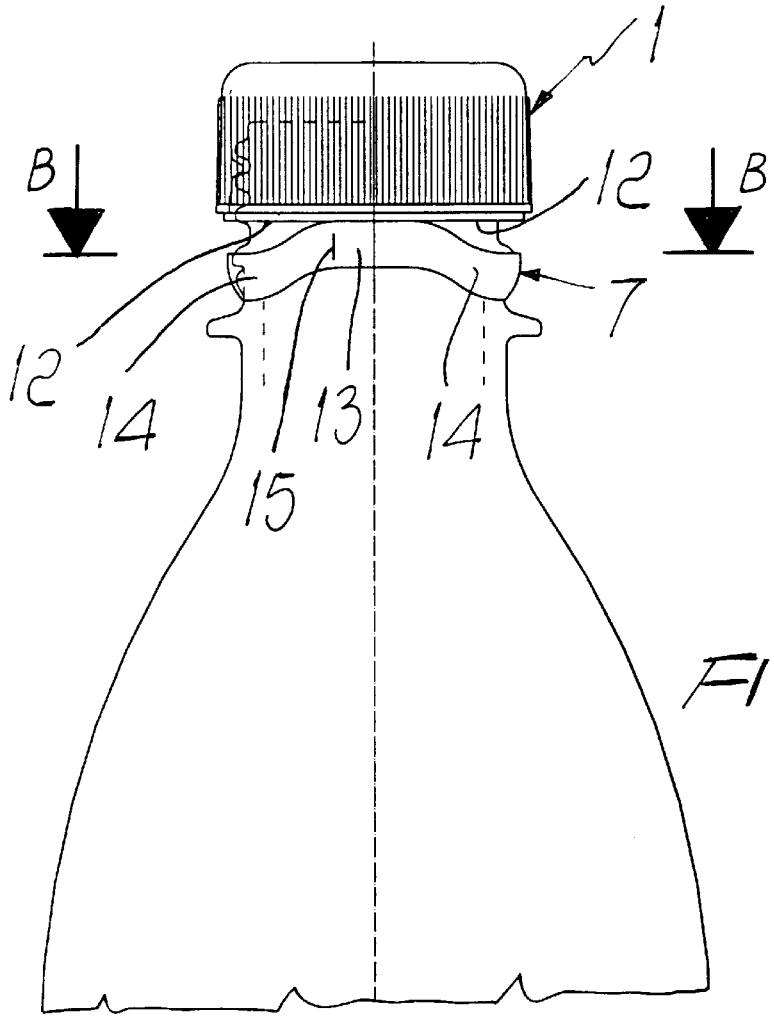
FIG. 5 is an elevation view of a container with the cap shown during the breaking of the tamper-evident ring.
Figure 6:
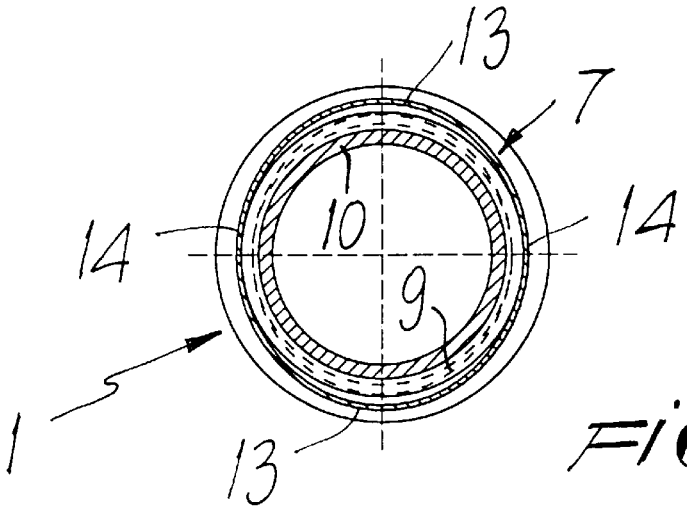
FIG. 6 is a sectional view, taken along the plane B—B of FIG. 5.

As shown in particular in FIGS. 4–6, the unscrewing of the cap, due to the abutment of the collar 9 of the ring 7 below the annular ridge 11, in fact causes, during a first step, the spacing of the portions 14 from the rim of the cup 2. Because of this spacing, the portions 14 are folded downward (FIG. 5), engaging even more below the annular ridge 11 and producing a safer engagement.

Figure 7:
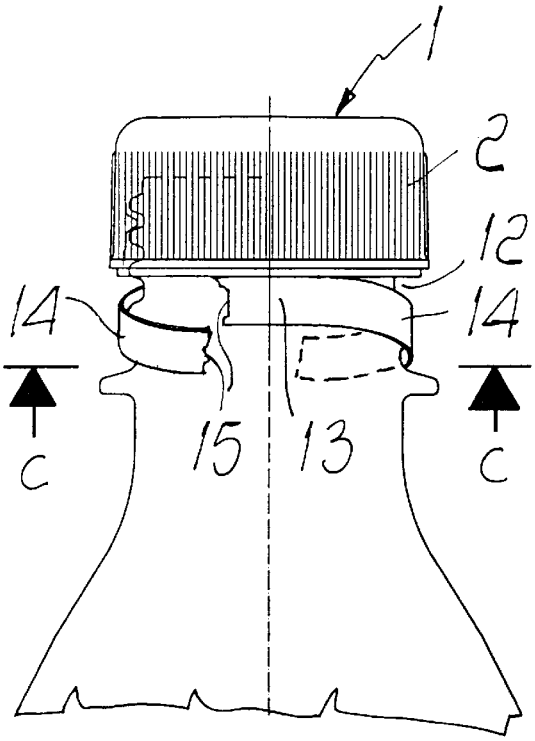
FIG. 7 is a side view of the cap of FIG. 1 after breaking the tamper-evident ring.
Figure 8:
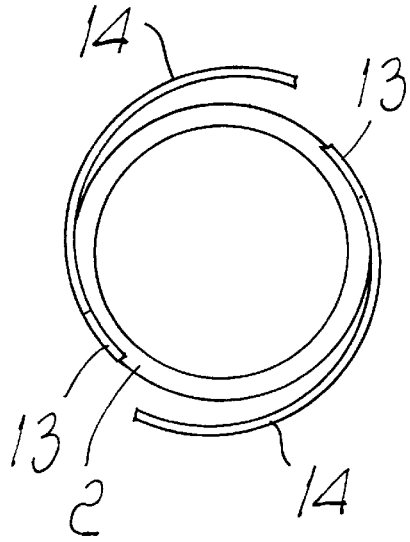
FIG. 8 is a sectional view, taken along the plane C— C of FIG. 7.

Upon subsequent unscrewing of the cap 1 from the container, the axial incisions 15, to the side of the bridges 13, produce the breaking of the portions 14 of the tamper-evident ring 7. As shown by FIGS. 7 and 8, after breakage the portions 14 open out away from the cup 2 with a helical arrangement, allowing easy removal of the cap.

Figure 9:
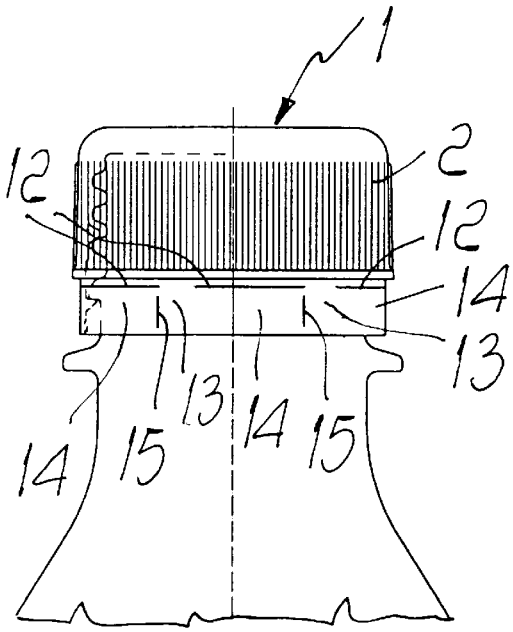
FIG. 9 is a view of the cap according to an embodiment of the invention.

The number of through incisions 12 can be different from the one specified here. For example, it is possible to provide a plurality of through incisions which are angularly equidistant, as shown in FIG. 9. Preferably, the number of incisions is lower than four, since if this number is exceeded the angular extension of the portions 14 decreases to the point of no longer ensuring valid engagement of the tamper-evident ring 7 below the annular ridge 11, besides increasing the unscrewing effort required to break the incisions 15.

It should be observed that the through incisions 12 do not compromise the ability of the tamper-evident ring 7 to expand radially during application of the cap to the container and do not compromise in any way the resistance of the container to tampering.

Figure 10:
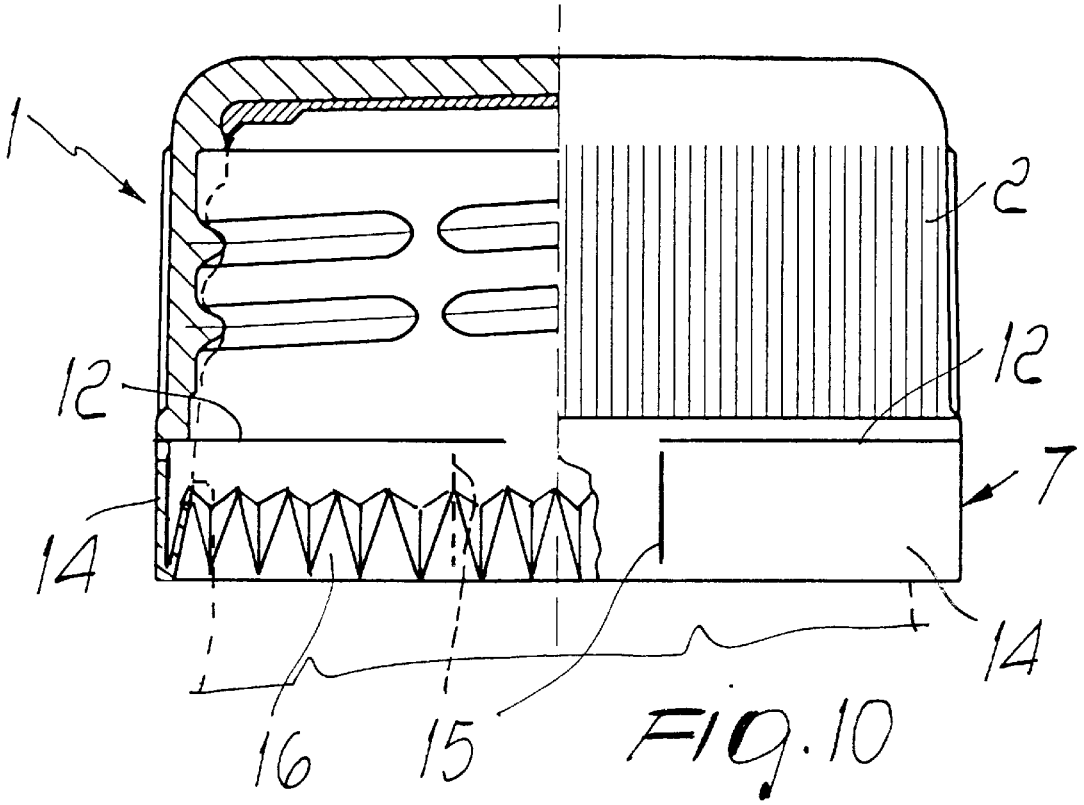
FIG. 10 is a view of the cap according to another embodiment.
Figure 11:
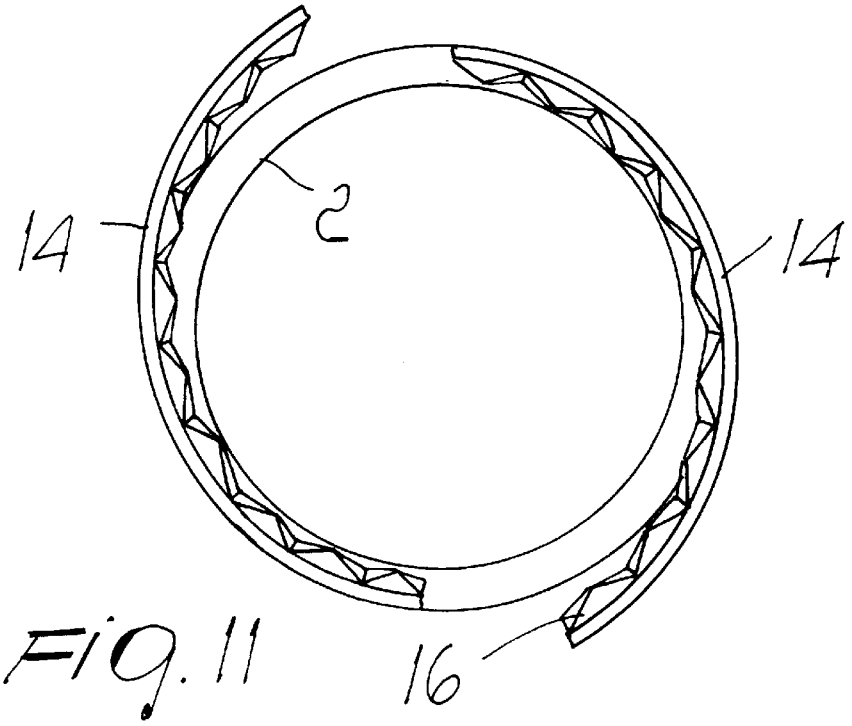
FIG. 11 is a view of the cap of FIG. 10, taken axially after breaking the tamper-evident ring.

The same inventive concept can be applied to caps provided with a tamper-evident ring which, instead of the continuous internal collar 9, has an undulated collar 16 (see FIGS. 10, 11) which protrudes inward at an angle from the lower rim of the ring 7 in order to engage below the annular ridge 11. With this embodiment, breaking of the tamper-evident ring during unscrewing occurs initially along the axial incisions 15 and then through the corrugated ring 16. It is also possible to provide for the axial incision 15 to also affect the corrugated collar 16.

Figure 12:
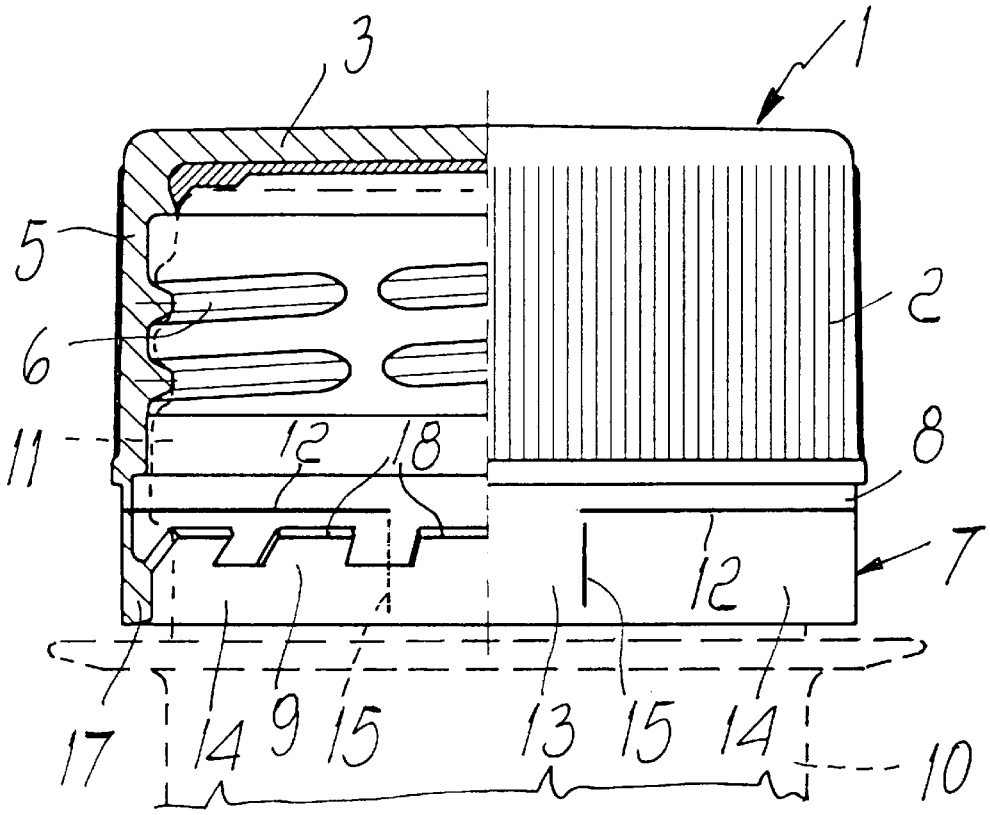
FIG. 12 is a partially sectional view of a cap according to another embodiment.

Another embodiment of a cap to which the inventive concept can be applied is shown in FIG. 12. Said cap is characterized by a tamper-evident ring 7 provided with an internal annular enlarged portion 17 from which equidistant teeth 18 protrude at an angle; said teeth are adapted to co-operate with the ridge 11 of the container.

The circumferential incisions 12 lie in the region between the annular enlarged portion 17 and the rim of the cup, while the axial incisions are preferably formed at the interspaces between the retention teeth 18.

Figure 13:
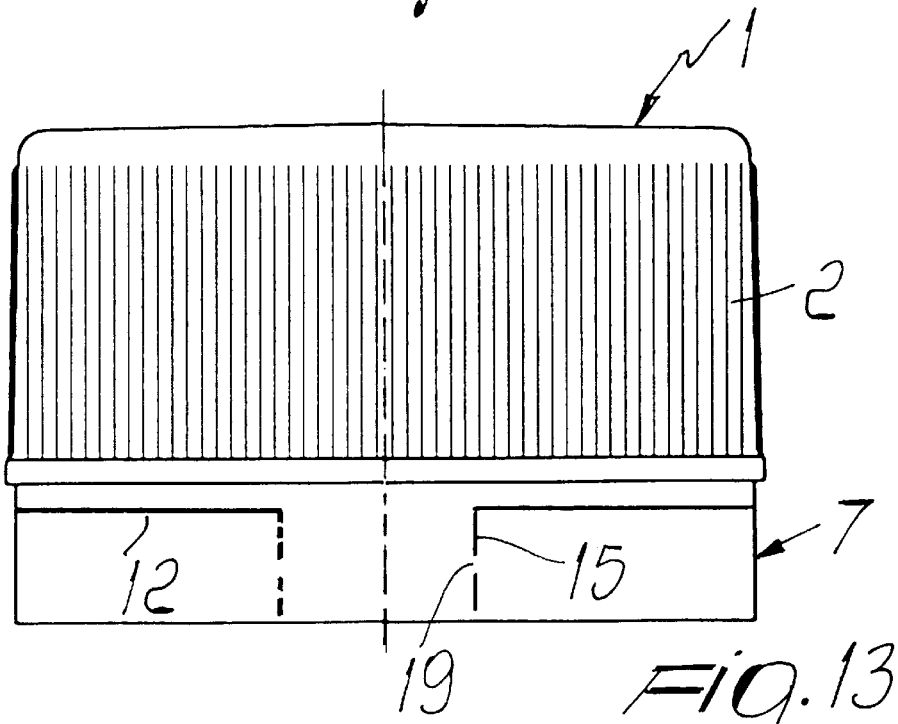
FIG. 13 is a view of another variation of the cap.

In the practical embodiment of the invention, the axial incisions 15 can be connected to the corresponding end of the circumferential incisions 12 so as to form an incision which, in the vicinity of the bridges 13, lies at right angles, as shown in FIG. 13.

FIG. 13 also shows the possibility to provide the axial incisions with discontinuities 19.

The incisions 12 and 15 can be formed during molding. However, said incisions are preferably obtained by means of a cutter provided with a blade which allows to easily and economically vary the number and depth of the incisions until they become through incisions.

The disclosures in Italian Patent Application No. B098A000523 from which this application claims priority are incorporated herein by reference.

What is claimed is:

1. A plastic screw cap for closing a container provided with an annular ridge, said plastic screw cap comprising:

a cylindrical cup having a bottom and a rim arranged opposite said bottom, an internal thread provided at an inner surface of said cylindrical cup;

a tamper-evident ring having a border, said tamper-evident ring attached at said border to said rim of said cylindrical cup;

retention means arranged on said tamper-evident ring for for retaining said tamper-evident ring below the annular ridge of the container to which said cylindrical cup is applied;

a connection region for providing connection between said rim of said cylindrical cup and said border of said tamper-evident ring; and one single pair of diametrically-opposite arranged incisions which extend circumferentially along said border of said tamper-evident ring, said single pair of incisions extending entirely through a thickness od said tamper-evident ring for separating said rim of said cylindrical cup and said border of said tamper-evident ring;

one single pair of diametrically-opposite arranged connecting bridges which extend circumferentially between said single pair of incisions; and a pair of axial incisions each of which is provided in said tamper-evident ring and extending axially adjacent a respective one of said single pair of connecting bridges.

2. The cap of claim 1, wherein said pair of axial incisions are arranged mutually diametrically opposite each other, and each one of said axial incisions is arranged adjacent an end of a respective one of said single pair of incisions.

3. The cap of claim 2, wherein said each one of said axial incisions has discontinuities.

4. The cap of claim 2, wherein said each one of said axial incisions is connected to said end of said respective one of said single pair of incisions.

5. The cap of claim 2, wherein said each one of said incisions extends entirely through said tamper-evident ring.

6. The cap of claim 2, wherein said each one of said axial incisions extends only partially in thickness through said tamper-evident ring.

* * * * *